US006156473A

United States Patent [19]

Tyagi et al.

[11] Patent Number: 6,156,473

[45] Date of Patent: Dec. 5, 2000

[54] MONODISPERSE SPHERICAL TONER PARTICLES CONTAINING ALIPHATIC AMIDES OR ALIPHATIC ACIDS

[75] Inventors: Dinesh Tyagi, Fairport; David E. Tyminski, Webster; Leo G. Proctor, Churchville; Domenic Santilli, Webster, all of N.Y.

[73] Assignee: Eastman Kodak Company, Rochester, N.Y.

[21] Appl. No.: 09/096,682

[22] Filed: Jun. 12, 1998

Related U.S. Application Data

[63] Continuation-in-part of application No. 08/672,172, Jun. 25, 1996, abandoned.

[60] Provisional application No. 60/003,081, Aug. 31, 1995.

[51] Int. Cl.[7] ..... G03G 9/087

[52] U.S. Cl. ..... 430/137; 430/109; 430/110

[58] Field of Search ..... 430/110, 111, 430/137, 109

[56] References Cited

U.S. PATENT DOCUMENTS

| | | | |
|---|---|---|---|
| 3,951,835 | 4/1976 | Tomono et al. | 430/110 |
| 3,969,251 | 7/1976 | Jones et al. | 430/109 |
| 4,100,087 | 7/1978 | Takayama et al. | 252/62.1 P |
| 4,367,275 | 1/1983 | Aoki et al. | 430/99 |
| 4,473,628 | 9/1984 | Kasuya et al. | 430/109 |
| 4,643,960 | 2/1987 | Quan | 430/106.6 |
| 4,745,418 | 5/1988 | Brennan et al. | 346/74.5 |
| 4,833,060 | 5/1989 | Nair et al. | 430/137 |
| 4,835,084 | 5/1989 | Nair et al. | 430/137 |
| 4,877,704 | 10/1989 | Takagiwa et al. | 430/109 |
| 4,965,131 | 10/1990 | Nair et al. | 428/407 |
| 5,002,847 | 3/1991 | Utsumi et al. | 430/137 |
| 5,049,469 | 9/1991 | Pierce et al. | 430/109 |
| 5,133,992 | 7/1992 | Nair et al. | 427/213.34 |
| 5,247,034 | 9/1993 | Mate et al. | 526/215 |
| 5,283,149 | 2/1994 | Tyagi et al. | 430/137 |
| 5,482,812 | 1/1996 | Hopper et al. | 430/137 |
| 5,494,768 | 2/1996 | Boswell et al. | 430/109 |
| 5,935,751 | 8/1999 | Matsuoka et al. | 430/137 |

FOREIGN PATENT DOCUMENTS 1570239 6/1980 United Kingdom .

OTHER PUBLICATIONS

Derwent Abstract WPI Acc. No. 88–107908/16 of JP 63055563, Mar. 10, 1988.

Derwent Abstract WPI Acc. No. 87–075955/11 of JP 62028770, Feb. 6, 1987.

Derwent Abstract WPI Acc. No. 84–259816/42 of JP 59157655, Sep. 7, 1984.

Derwent Abstract WPI Acc. No. 84–267267/43 of JP 59164560, Sep. 17, 1984.

Derwent Abstract WPI Acc. No. 92–272229/33 of JP 4184348, Jul. 1, 1992.

Derwent Abstract WPI Acc. No. 91–202730/28 of JP 3126044, May 29, 1991.

Derwent Abstract WPI Acc. No. 88–326715/46 of JP 63240559, Oct. 6, 1988.

Derwent Abstract WPI Acc. No. 88–109081/16 of JP 63058354, Mar. 14, 1988.

Derwent Abstract WPI Acc. No. 85–090192/15 of JP 60039655, Mar. 1, 1985.

*Primary Examiner*—Janis L. Dote

*Attorney, Agent, or Firm*—Doreen M. Wells

[57] ABSTRACT

A nonconductive toner composition comprising monodisperse spherical particles includes a binder polymer, a charge control agent, and an aliphatic acid or aliphatic amide uniformly distributed in the particles and present in an amount of 2.5 to 30% by weight of the toner composition. A method of forming a toner particle composition comprises the steps of: milling an aliphatic amide or an aliphatic acid in the presence of a binder polymer and a water-immiscible organic binder solvent to form a concentrate wherein the particle size of the aliphatic amide or aliphatic acid is less than one micrometer; dissolving a binder polymer and a charge control agent in a water-immiscible organic binder solvent to form a binder solution; mixing the aliphatic amide or aliphatic acid concentrate with the binder solution to form an aliphatic amide- or aliphatic acid-binder polymer dispersion; dispersing the aliphatic amide- or aliphatic acid-binder polymer dispersion in water containing a colloidal stabilizer to form an aqueous suspension of droplets; subjecting the droplets to shearing action to reduce droplet size and form limited coalescence particles; removing the water-immiscible organic binder solvent from the limited coalescence particles to form toner particles in an aqueous medium; and drying the toner particles.

8 Claims, No Drawings

MONODISPERSE SPHERICAL TONER PARTICLES CONTAINING ALIPHATIC AMIDES OR ALIPHATIC ACIDS

CROSS-REFERENCE TO RELATED APPLICATIONS

This is a continuation-in-part application of Ser. No. 08/672,172 filed Jun. 25, 1996, now abandoned, entitled "Monodisperse Spherical Toner Particles Containing Aliphatic Amides or Aliphatic Acids" and claims priority from Provisional Application Ser. No. 60/003,081, filed Aug. 31, 1995.

FIELD OF THE INVENTION

The present invention relates to toner compositions useful in electrophotographic processes. The invention also relates to methods for producing these toner compositions.

BACKGROUND OF THE INVENTION

In electrophotography (sometimes more generally referred to as electrostatography), an image comprising a pattern of electrostatic potential (also referred to as an electrostatic latent image) can be formed on a surface of an electrophotographic element and is then developed into a toner image by contacting the latent image with an electrographic developer. If desired, the latent image can be transferred to another surface before development. The toner image is eventually transferred to a receiver, to which it is fused, typically by heat and pressure.

Toners typically contain a binder and other additives, such as colorants. Binders are generally polymeric and are selected so as to provide a balance between various conflicting constraints. One of the most common additives that is used in toner compositions is a release additive such as low molecular weight polyolefin waxes or fatty acids or fatty amides or salts thereof. These "release additives" are present to impart better release of the toner melt from the fuser roller surface during the fusing process. This is achieved with the combination of a low surface energy roller, e.g., a polytetrafluoroethylene coated roller, and a toner that contains preferably 1–2% by weight of the release additives in the toner composition. Examples of patents that disclose these release additives in toner compositions include: GB 1,570,239; JP A 63-55563; and JP A 62-28770.

Toner compositions having release additives are made by melt compounding and pulverization. This process produces a wide particle size distribution and poor particle shapes leading to the less than desired image quality.

While the images that are made with the toner compositions having release additives are acceptable in many respects, they have less than desired abrasion resistance and less than desired image quality because of the irregular shape of the toner particles and because of the wide particle size distribution. Further, where these toner compositions are used to make glossy images, these images are susceptible to finger prints and damage when placed against a plasticized vinyl surface.

In U.S. Pat. No. 4,643,960, there is described a method wherein the irregular shaped powder is further processed by aspirating it into a moving gas stream. The aerosol produced is directed through a stream of hot gas and into a cooling chamber. This produces polydisperse spherical particles. These spherical particles of binder are then dry blended with pigment to produce a conductive toner composition. A small amount of fatty acid amide, e.g., 0.05 to 5% by weight, can be used on the surface of the particles to facilitate the dry blending process. No charge control agents are used. U.S. Pat. No. 4,745,418 is similar.

U.S. Pat. Nos. 4,833,060; 4,835,084; 4,965,131; 5,049,469 and 5,133,992 all teach the methods of preparing making toners using colloidally stabilized suspension polymerization or evaporation processes. By using the techniques described in these patents, it is possible to formulate narrow particle size distribution toners by utilizing either polymerization or evaporation limited coalescence methods. In the case of polymerization limited coalescence technique, a mixture of monomers, wherein the desired pigment (where present) dispersion has been incorporated along with appropriate charge agents, polymerization initiator, chain transfer agents is colloidally stabilized in an aqueous media. The stabilized particles are then polymerized under appropriate conditions and the resulting toner particles isolated by various procedures as described in these patents.

In the evaporative limited coalescence technique, an organic solvent solution of preformed binder polymer, wherein the desired pigment (where present) dispersion and charge agents have been incorporated, is colloidally stabilized in an aqueous media. The desired toner particles are formed once the organic solvent is allowed to evaporate and the subsequent particles isolated. These toners can now be used directly in an electrophotographic process without any further processing such as melt compounding.

These techniques are very useful for preparing toner with narrow particle size distributions. They are particularly useful for preparing small toner particles that are less than 7 micrometers volume average diameter in size and composition which have no particles less than 2 micrometers. However, these techniques are not useful if a release additive such as low molecular weight polyolefins, etc., are required to be added to the toner formulation. In conventional melt compounding and pulverizing methods where release additives can be added, the process of melt kneading the toner binder, pigments and charge agents, etc., is carried out at sufficiently high temperatures to permit melting of any low surface energy release additive. Since the limited coalescence processes are carried out at ambient or low temperatures, the incorporation of release additives by melting is not possible. Thus, prior to the present invention, it has not been possible to obtain monodisperse spherical toner particles with any significant amount of release additives. In particular, it is not feasible to uniformally incorporate any significant amount of an aliphatic amide or aliphatic acid by incorporating it into the polymerizable monomer before suspension polymerization, or by other methods. (See U.S. Pat. No. 5,133,992, col 10 lines 29–36.)

Other toner compositions are known which contain high quantities of the low molecular weight polyolefin waxes or fatty acids or fatty amides or salts thereof. In this case, these components are present not to provide improved release but rather to provide a wax binder for "pressure fixing". In this process, pressure is used to fix the latent image onto the receiver sheet. Heat is not necessary and relatively large amounts of the waxy substance are needed to provide this effect. As a result of the high level of this waxy binder, the toner image itself has an undesirable waxy character. Processes of this type are disclosed in U.S. Pat. Nos. 4,100,087; and 4,745,418.

There is a continuing need for toner compositions that have desirable image characteristics as well as improved release properties and abrasion resistance.

SUMMARY OF THE INVENTION

We have found methods for the incorporation of an aliphatic amide or aliphatic acid into toner particles that are monodisperse spherical particles.

Thus, in accordance with one aspect of the present invention there is provided a nonconductive toner composition which comprises monodisperse spherical particles comprising:

a) a binder polymer;

b) a charge control agent; and c) an aliphatic amide or an aliphatic acid, uniformly distributed in the particles and present in an amount of from 2.5 to 30% by weight of the toner composition.

In another aspect of the present invention there is provided a method for producing the described toner composition. Thus, there is provided a method comprising the steps of:

a) milling an aliphatic amide or an aliphatic acid in the presence of binder polymer and a water immiscible organic binder solvent to produce aliphatic amide or aliphatic acid concentrate wherein the particle size of said aliphatic amide or aliphatic acid is less than one micrometer;

b) dissolving binder polymer and charge control agent in a water immiscible organic binder solvent to produce binder solution;

c) dispersing a colloidal stabilizer in water to produce a stabilizer dispersion;

d) mixing said aliphatic amide or aliphatic acid concentrate from step a) with said binder solution from step b) to produce aliphatic amide or aliphatic acid-binder polymer dispersion;

e) shearing the stabilizer dispersion and the aliphatic amide or aliphatic acid-binder polymer dispersion from step d) to reduce the size of the limited coalescence particles;

f) removing the water immiscible organic binder solvent from the limited coalescence particles to produce toner particles in aqueous media; and g) drying the toner particles.

The toner particles of the invention have significant advantages compared to other toner particles. They provide images with excellent image characteristics because of their narrow particle size distribution and spherical shape. The spherical toner particles of the invention are described herein as "monodisperse", meaning that the fineness index of the particles of the invention is between 0.75 and 1.35, preferably between 1.00 and 1.20 and the coarseness index is also between 0.75 and 1.35, preferably between 1.00 and 1.20. Such "monodisperse" particles are formed at low or ambient temperatures; unlike toner particles formed by melt compounding where heat is used to make the material flow in a fluid-like form.

The toner exhibits excellent release properties from heated fuser members. Finally, because of the uniform distribution of the aliphatic amide or aliphatic acid and because of the relatively high concentration of the aliphatic amide or aliphatic acid, the images produced from the toners of the invention have excellent abrasion resistance, resistance to sticking to vinyl and excellent ability to remove finger prints.

DETAILED DESCRIPTION OF THE INVENTION

In accordance with the invention, there is provided a toner composition which includes three components: binder polymer; charge control agent; and an aliphatic amide or an aliphatic acid. All of these components are individually well known in this art and any of the known examples of these components can be used in the practice of the invention.

Useful binder polymers include vinyl polymers, such as homopolymers and copolymers of styrene monomers condensation polymers such as polyesters and copolyesters. Particularly useful binder polymers are styrene polymers of from 40 to 100 percent by weight of styrene monomers and from 0 to 45 percent by weight of one or more alkyl acrylate monomers or alkyl methacrylate monomers. Fusible styrene-acrylic copolymers which are covalently lightly crosslinked with a divinyl compound such as divinylbenzene, as disclosed in U.S. Reissue Pat. No. 31,072, are particularly useful. Also especially useful are polyesters of aromatic dicarboxylic acids with one or more aliphatic diols, such as polyesters of isophthalic or terephthalic acid with diols such as ethylene glycol, cyclohexane dimethanol and bisphenols.

Another useful binder polymer composition comprises:

a copolymer of (a) at least one vinyl aromatic monomer; (b) at least one second monomer selected from the group consisting of conjugated diene monomers and acrylate monomers selected from the group consisting of alkyl acrylate monomers and alkyl methacrylate monomers.

Yet another useful binder polymer composition comprises:

a) a copolymer of a vinyl aromatic monomer; a second monomer selected from the group consisting of conjugated diene monomers or acrylate monomers selected from the group consisting of alkyl acrylate monomers and alkyl methacrylate monomers; and b) the acid form of an amino acid soap which is the salt of an alkyl sarcosine having an alkyl group which contains from about 10 to about 20 carbon atoms. Binder polymer compositions of this type with a third monomer which is a crosslinking agent are described in. U.S. application Ser. No. 08/657,473 entitled TONER COMPOSITIONS INCLUDING CROSSLINKED POLYMER BINDERS, and filed in the names of Tyagi and Hadcock on May 28, 1996 now abandoned, which was refiled as application Ser. No. 09/016,065, a C-I-P of 08/657,473 and now issued U.S. Pat. No. 5,968,700. Binder polymer compositions of this type without the crosslinker are made in accordance with the process described in U.S. Pat. No. 5,247,034.

Another component of the toner composition is a charge control agent. The term "charge control" refers to a propensity of a toner addendum to modify the triboelectric charging properties of the resulting toner. A very wide variety of charge control agents for positive charging toners are available. A large, but lesser number of charge control agents for negative charging toners is also available. Suitable charge control agents are disclosed, for example, in U.S. Pat. Nos. 3,893,935; 4,079,014; 4,323,634; 4,394,430 and British Patent Nos. 1,501,065; and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553. Mixtures of charge control agents can also be used.

An optional component of the toner is colorant: a pigment or dye. Suitable dyes and pigments are disclosed, for example, in U.S. Reissue Pat. No. 31,072 and in U.S. Pat. Nos. 4,160,644; 4,416,965; 4,414,152; and 2,229,513. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent. Mixtures of colorants can also be used.

The third component of the toner composition is an aliphatic amide or aliphatic acid. Suitable aliphatic amides and aliphatic acids are described, for example, in "Practical Organic Chemistry", Arthur I. Vogel, 3rd Ed. John Wiley and Sons, Inc. N.Y. (1962); and "Thermoplastic Additives: Theory and Practice" John T. Lutz Jr. Ed., Marcel Dekker, Inc, N.Y. (1989). Particularly useful aliphatic amide or aliphatic acids have from 8 to about 24 carbon atoms in the aliphatic chain. Examples of useful aliphatic amides and aliphatic acids include oleamide, eucamide, stearamide, behenamide, ehthylene bis(oleamide), ethylene bis (stearamide), ethylene bis(behenamide) and long chain acids including stearic, lauric, montanic, behenic, oleic and tall oil acids. Particularly preferred aliphatic amides and acids include stearamide, erucamide, ethylene bis-stearamide and stearic acid. The aliphatic amide or aliphatic acid is present in an amount from 2.5 to 30 percent by weight, preferably from about 5 to 8 percent by weight. Mixtures of aliphatic amides and aliphatic acids can also be used. One useful stearamide is commercially available from Witco Corporation as KENAMIDE®S. A useful stearic acid is available from Witco Corporation as HYSTERENE® 9718.

The concentration of the aliphatic amide or aliphatic acid in the toner composition is from 2.5 to 30% by weight of the toner composition. This concentration is somewhat greater than the concentration of prior art compositions where the aliphatic amide or aliphatic acid is used as a release agent. For that function, the weight percent is usually in the range of 1–2% by weight. This concentration is somewhat less than the concentration of prior art compositions where the aliphatic amide or aliphatic acid is used as a pressure fixing binder. As noted previously, such pressure fixing compositions require at least about 35% by weight of a waxy substance and typically much higher.

A characteristic of the toner particles in the present composition is that they are monodisperse and spherical. This is a result of the way that they are made, e.g., by an evaporative limited coalescence method described in more detail below. This is in sharp contrast to toner particles that are made by conventional melt compounding and pulverization. The latter process produces a composition with a very large particle size distribution. Further, the particles are produced by fracturing larger particles and are characterized by nonuniform and sometimes sharp edges. By microscopic examination, one of skill in this art can easily distinguish the monodisperse spherical particles that are a characteristic of the present invention from the polydisperse fractured particles made by melt compounding and pulverization.

While the presence of a monodisperse particle size distribution can be determined from a visual microscopic inspection, monodispersity can also be measured using conventional particle sizing techniques. The monodispersity can be quantified by specifying a "fineness index" and a "coarseness index". The fineness index is defined as the ratio $d_{50}/d_{16}$. For example, the "$d_{50}$" is determined from the cumulative number particle size distribution curve and corresponds to the size at which the cumulative number of particles reaches 50%. Similarly, the coarseness index is defined as the $D_{84}/D_{50}$. In this case, the "$D_{50}$" is similar to "$d_{50}$" but refers to the size obtained from the cumulative volume particle size distribution curve and corresponds to the size at which the cumulative volume of particles reaches 50%. In accordance with the preferred embodiments of the invention, the fineness index of the monodisperse spherical toner particles of the invention is between 0.75 and 1.35 and the coarseness index is also between 0.75 and 1.35. For comparison purposes, a typical number for a toner composition made by a technique that includes a pulverization step is about 1.5.

The toner can also contain other additives of the type used in previous toners, including magnetic pigments, leveling agents, surfactants, stabilizers, and the like. The total quantity of such additives can vary. A present preference is to employ not more than about 10 weight percent of such additives on a total toner powder composition weight basis. In the case of MICR (magnetic ink character recognition) toners, the weight percent of iron oxide could be as high as 40% by weight.

A developer can include a carrier and the described toner composition. Carriers can be conductive, non-conductive, magnetic, or non-magnetic. Carriers are particulate and can be glass beads; crystals of inorganic salts such as aluminum potassium chloride, ammonium chloride, or sodium nitrate; granules of zirconia, silicon, or silica; particles of hard resin such as poly(methyl methacrylate); and particles of elemental metal or alloy or oxide such as iron, steel, nickel, carborundum, cobalt, oxidized iron and mixtures of such materials. Examples of carriers are disclosed in U.S. Pat. Nos. 3,850,663 and 3,970,571. Especially useful in magnetic brush development procedures are iron particles such as porous iron, particles having oxidized surfaces, steel particles, and other "hard" and "soft" ferromagnetic materials such as gamma ferric oxides or ferrites of barium, strontium, lead, magnesium, or aluminum. Such carriers are disclosed in U.S. Pat. Nos. 4,042,518; 4,478,925; 4,764,445, 5,306,592 and 4,546,060.

Carrier particles can be uncoated or can be coated with a thin layer of a film-forming resin to establish the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. Other useful resins are fluorocarbons such as polytetrafluoroethylene, poly(vinylidene fluoride), mixtures of these, and copolymers of vinylidene fluoride and tetrafluoroethylene. See for example, U.S. Pat. Nos. 4,545,060; 4,478,925; 4,076,857; and 3,970,571; and 4,726,994. Polymeric fluorocarbon coatings can aid the developer to meet the electrostatic force requirements mentioned above by shifting the carrier particles to a position in the triboelectric series different from that of the uncoated carrier core material to adjust the degree of triboelectric charging of both the carrier and toner particles. The polymeric fluorocarbon coatings can also reduce the frictional characteristics of the carrier particles in order to improve developer flow properties; reduce the surface hardness of the carrier particles to reduce carrier particle breakage and abrasion on the photoconductor and other components; reduce the tendency of toner particles or other materials to undesirably permanently adhere to carrier particles; and alter electrical resistance of the carrier particles. Currently preferred is a mixture of poly(vinlyidene fluoride) and poly(methyl methacrylate) as described for example in U.S. Pat. Nos. 4,590,140; 4,209,550; 4,297,427 and 4,937,166.

The carrier can be strontium ferrite coated with fluorocarbon on a 0.5 percent weight/weight basis, and treated with an aqueous solution of 4 weight percent KOH and 4 weight percent of a 2 parts by weight to 1 parts by weight mixture of $Na_2S_2O_8$ and $Na_2S_2O_5$ as disclosed in U.S. patent application Ser. No. 08/127,382, filed Sep. 24, 1993, now issued U.S. Pat. No. 5,411,832, by William E. Yoerger, which is hereby incorporated herein by reference. The fluorocarbon carrier is also referred to as "modified KYNAR®". In a preferred embodiment, the carrier is sponge iron, which is sieved, oxidized and coated with fluorocarbon on a 0.2 eight percent basis.

In a particular embodiment, the developer contains from about 1 to about 20 percent by weight of toner and from about 80 to about 99 percent by weight of carrier particles. Usually, carrier particles are larger than toner particles. Conventional carrier particles have a particle size of from about 5 to about 1200 micrometers and are generally from 20 to 200 micrometers.

The developer can be made by simply mixing the described Toner composition and the carrier in a suitable mixing device. The components are mixed until the developer achieves a maximum charge. Useful mixing devices include roll mills and other high energy mixing devices.

Toners can optionally incorporate a small quantity of low surface energy material, as described in U.S. Pat. Nos. 4,517,272 and 4,758,491. Optionally the toner can contain a particulate additive on its surface such as the particulate additive disclosed in U.S. Pat. No. 5,192,637.

The term "particle size" used herein, or the term "size", or "sized" as employed herein in reference to the term "particles", means the median volume weighted diameter as measured by conventional diameter measuring devices, such as a Coulter Multisizer, sold by Coulter, Inc. of Hialeah, Fla. Median volume weighted diameter is the diameter of an equivalent weight spherical particle which represents the median for a sample.

Method of Making the Toner Composition

The toner compositions of the invention can be made with a process that is a modification of the evaporative limited coalescence process described in U.S. Pat. No. 4,883,060, the disclosure of which is hereby incorporated by reference. A binder polymer and a charge control agent are dissolved in a water-immiscible organic binder solvent to form a binder solution, which is dispersed in water containing a colloidal stabilizer such as silica to form an aqueous suspension of droplets that is subjected to high shear to reduce droplet size and form limited coalescence particles. The water immiscible organic solvent is then removed so as to produce a suspension of monodisperse spherical particles of the binder. The water is then removed and the toner composition recovered. The '060 patent discloses the use of a promoter and a silica stabilizer during the process. The silica can be removed by a KOH or HF wash. A polymeric latex can be used as a stabilizer and this is described in U.S. Pat. No. 4,965,131.

The method of the present invention includes all of the fundamental steps of this process but includes a preliminary step wherein the aliphatic amide or aliphatic acid is milled in the presence of a solution of the binder polymer so as to form a dispersion of fine particles of the aliphatic amide or aliphatic acid in the binder polymer solution. This concentrate is then added to the remainder of the binder polymer solution and the process according to the '060 patent is carried out. This produces binder polymer particles wherein the aliphatic amide or aliphatic acid is uniformly distributed in the polymer binder.

To make the aliphatic amide or aliphatic acid concentrate, the aliphatic amide or aliphatic acid is milled. The mechanical means applied to reduce the particle size of the aliphatic amide or aliphatic acid conveniently can take the form of a dispersion mill. Suitable dispersion mills include a ball mill, an attritor mill, a vibratory mill, and media mills such as a sand mill and a bead mill. A media mill is preferred due to the relatively shorter milling time required to provide the intended result, i.e., the desired reduction in particle size. For media milling, the apparent viscosity of the concentrate (that is the aliphatic amide or aliphatic acid, binder polymer and solvent) preferably is from about 10 to about 1000 centipoise. For ball milling, the apparent ending viscosity of the concentrate preferably is from about 1 up to about 100 centipoise. Such ranges tend to afford an optimal balance between efficient particle fragmentation and media erosion. (Unless otherwise noted, the viscosity given is the "ending viscosity" or the viscosity that is achieved at the end of the milling process. It will be understood that the viscosity will change during milling.) This concentrate typically contains about 5–20 percent by weight aliphatic amide or aliphatic acid; and about 5–20 binder polymer, the remainder being solvent.

The attrition time can vary widely and depends primarily upon the particular mechanical means and processing conditions selected. For ball mills, processing times of up to five days or longer may be required. On the other hand, processing times of less than 1 day (residence times of one minute up to several hours) have provided the desired results using a high shear media mill.

The aliphatic amide or aliphatic acid particles must be reduced in size at a temperature which does not significantly degrade or melt the amide. Processing temperatures of less than about 30–40° C. are ordinarily preferred. If desired, the processing equipment can be cooled with conventional cooling equipment. The method is conveniently carried out under conditions of ambient temperature and at processing pressures which are safe and effective for the milling process. For example, ambient processing pressures are typical of ball mills, attritor mills and vibratory mills. Control of the temperature, e.g., by jacketing or immersion of the milling chamber in ice water are contemplated. Processing pressures from about 1 psi (0.07 kg/cm2) up to about 50 psi (3.5 kg/cm2) are contemplated. Processing pressures from about 10 psi (0.7 kg/cm2) to about 20 psi (1.4 kg/cm2) are typical.

More particularly, the preferred process of the '060 patent can be carried out by first forming a solution of a polymer in a solvent that is immiscible with water. The milled aliphatic amide or aliphatic acid in polymer solution is added to this solution of binder polymer. The next step is dispersing the polymersolvent solution in water containing a promoter and silica particles having an average particle size of from 0.001 to 1 $\mu$m and being present in a concentration of from 0.5 to 21 milliliters of a 50 percent by weight dispersion in water based on 100 grams of the polymer and solvent present, preferably in an amount from 0.5 to 10 milliliters of a 50 percent by weight dispersion/100 grams of solvent and polymer, the silica being present as a water-insoluble solid particulate suspension stabilizer. The process continues by subjecting the dispersion to a shearing action thereby reducing the particle size of the droplets in water. The water immiscible solvent and solid silica particulate suspension stabilizer are then removed from the polymer particles thus formed and the polymeric powder is recovered from the water phase.

The polymer from which the polymeric powders are to be made is dissolved in a quantity of a solvent, the solvent being immiscible with water. The quantity of solvent in this final solution of binder polymer (the "aliphatic amide or aliphatic acid-binder polymer dispersion"), including the solvent from the aliphatic amide or aliphatic acid concentrate that is added to the polymer solution, is important in that the size of the particles thus prepared under given agitation conditions influences the size of the powder particles that result. It is generally the case that higher concentrations of polymer in the solvent produce larger particle size powder particles having a lower degree of shrinkage than that produced by lower concentrations of polymer in the same solvent. The concentration of the polymer in the solvent should be from about 1 to about 80 and preferably from about 2 to about 60% by weight. When preparing electrographic toner particles the concentration of polymer in solvent is generally maintained at from 10 to 35% by weight for a polymer resin having a number average molecular weight of 550,000.

The solution of polymer in the solvent is next introduced into an aqueous solution containing a particulate dispersing agent and a promoter which drives the particulate dispersing agent to the interface between the water layer and the polymer solvent droplets formed by the agitation conducted on the system. To achieve this effect, it is generally desired to control the pH of the system at a value of from about 2 to about 7, preferably from about 3 to 6 and most preferably 4. The promoter can be present in an amount of 1 to about 10 percent and preferably from about 2 to 7 percent based on the weight of the polymer and solvent. The size of the droplets formed, depends on the shearing action on the system plus the amount of the particulate dispersing agent employed. While any high shear type agitation device is useful, it is preferred that the polymer in solution be introduced into the aqueous phase in a microfluidizer such as Model No. 11OT produced by Microfluidics Manufacturing. Each of the polymer-in-solution droplets are surrounded by the solid dispersing agent limits and controls both the size and size distribution of the solvent-polymer droplets.

As indicated, after exiting the microfluidizer, the particle size of the polymer/solvent droplets are established. The solvent is next removed from the droplets by any suitable technique, such as, for example, heating the entire system to vaporize the solvent and thus remove it from the discontinuous phase droplets remaining in the aqueous solution surrounded by the silica particles.

Next, it is preferred that the silica dispersing agent be removed from the surface of the polymer particles by any suitable technique such as dissolving in HF or other fluoride ion or by adding an alkaline agent such as potassium hydroxide to the aqueous phase containing the polymer particles to thereby raise the pH to at least about 12 while stirring. Subsequent to raising the pH and dissolving the silica, the polymer particles can be recovered by filtration and finally washed with water or other agents to remove any desired impurities from the surface thereof.

Any suitable solvent that will dissolve the polymer and which is also immiscible with water may be used such as for example, chloromethane, dichloromethane, ethyl acetate, propyl acetate, vinyl chloride, MEK, trichloromethane, carbon tetrachloride, ethylene chloride, trichloroethane, toluene, xylene, cyclohexanone, 2-nitropropane and the like. Particularly useful solvents are ethyl acetate, propyl acetate, and dichloromethane for the reason that they are good solvents for many polymers while at the same time they are immiscible with water. Further, its volatility is such that it is readily removed from the discontinuous phase droplets by evaporation.

Any suitable promoter that is water soluble and effects the hydrophilic/hydrophobic balance of the solid dispersing agent in the aqueous solution may be employed in order to drive the solid dispersing agent to the polymer/solvent droplet-water interface, such as, for example, sulfonated polystyrenes, alginates, carboxymethyl cellulose, tetramethyl ammonium hydroxide or chloride, diethylaminoethylmethacrylate, water-soluble complex resinous amine condensation products such as the water soluble condensation products of diethanol amine and adipic acid, a particularly suitable one of this type is poly(adipic acid-co-methylaminoethanol), water-soluble condensation products of ethylene oxide, area and formaldehyde and polyethyleneimine. Also effective as promoters are gelatin, glue, casein, albumin, gluten and the like. Nonionic materials such as methoxy cellulose may be used. Generally, the promoter is used in amounts of from about at least 0.2 and preferably 0.25 to about 0.6 parts per 100 parts of aqueous solution.

In accordance with this invention, the quantities of the various ingredients and their relationship to each other can vary over wide ranges, however, it has generally been found that the ratio of the polymer to the solvent should vary in an amount of from about 1 to about 80 percent by weight of combined weight of the polymer and the solvent and that the combined weight of the polymer in the solvent should vary with respect to the quantity of water employed in an amount of from about 25 to about 50 percent in weight. Also, the size and quantity of the solid dispersing agent depends upon the size of the particles of the solid dispersing agent and also upon the size of the toner particles desired. Thus, as the size of the polymer/solvent droplets are made smaller by the shear agitation, the quantity of the silica dispersing agent varies in order to prevent the uncontrolled coalescence of the particles and in order to achieve uniform size and size distribution in the particles that result. Particles having an average size of from 0.05 $\mu$m to 100 $\mu$m and preferably from 0.1 $\mu$m to 60 $\mu$m may be prepared in accordance with this process.

Uses of the Toner Compositions

The toner of the invention can be used in a variety of ways to develop electrostatic charge patterns or latent images. Such developable charge patterns can be prepared by a number of methods and are then carried by a suitable element. The charge pattern can be carried, for example, on a light sensitive photoconductive element or a non-light-sensitive dielectric surface element, such as an insulator coated conductive sheet. One suitable development technique involves cascading developer across the electrostatic charge pattern. Another technique involves applying toner particles from a magnetic brush. This technique involves the use of magnetically attractable carrier cores. After image-wise deposition of the toner particles the image can be fixed, for example, by heating the toner to cause it to fuse to the substrate carrying the toner. If desired, the unfused image can be transferred to a receiver such as a blank sheet of copy paper and then fused to form a permanent image.

The described toner compositions are particularly useful for thermal assisted transfer of small toner particles to a desired receiver. Small toner particles are required to achieve higher resolution images but, as the size of the toner particles falls below about 8 micrometers, the forces holding the toner particles to the substrate tend to dominate over the electrostatic force that can be applied to the particles to assist their transfer to the receiver. Thus, in a preferred process for transferring small toner particles, the receiver is heated but not to an extent to melt the particles. This tends to fuse the toner particles at their points of contact and thus facilitate the transfer. Processes of this type are described in U.S. Pat. Nos. 4,927,727; 4,968,578; 5,037,718; 5,043,242; and 5,045,424, the disclosures of which are incorporated by reference. As a result, a preferred embodiment of the toner compositions of the invention is a toner composition wherein the binder polymer is a styrenic polymer or a copolymer of styrene and a methacrylate or acrylate; a midpoint glass transition temperature of from 55 to 65° C. and a number average molecular weight of from 2000 to about 50,000; and a particle size less than about 6 micrometers.

The described toner compositions are also particularly useful as clear toner compositions that assist in the transfer of small toner particles using a compliant intermediate transfer member. The use of clear toner particles (particles not including a colorant) to assist in the transfer of small marking toner particles through the use of a compliant intermediate transfer member is not our invention but is the invention of our coworkers and is described in commonly assigned copending U.S. application Ser. No. 08/572,559 entitled APPARATUS AND METHOD OF TONER TRANSFER USING NON-MARKING TONER, and filed in the names of Tombs, May, Rimai, and Zeman on Dec. 14, 1995 which is now issued U.S. Pat. No. 5,737,677.

The following examples are presented for a further understanding of the invention. In the following examples, the following charge control agents were used (Table 1):

TABLE 1

Charge Control Agents

| Agent | Description | U.S. Pat. No. |
|---|---|---|
| CCA-1 | tetradecyl pyridinium tetraphenyl borate | |
| CCA-2 | dodecylbenzyl dimethyl ammonium 3-nitrobenzene sulfonate | 4,834,920<br>4,840,864 |
| CCA-3 | 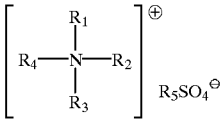 | 4,683,188<br>4,780,553 |
| CCA-4 | 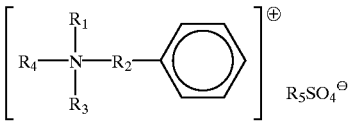 | 4,654,175<br>4,826,749<br>4,931,588 |
| CCA-5 | o-benzoic sulfimide | 5,358,818 |
| CCA-6 | n-(3,5-ditertbutyl-4-hydroxy benzoyl)-4-chloro benzene sulfonamide | 5,405,727 |
| CCA-7 | Hodogaya TNS-4-1 (aromatic condensation compound) | |
| CCA-8 | POLYTRIBO FCA-1001NB (polymeric negative charge agent) | |

EXAMPLE 1

A number of toner compositions were made according to the invention using the process of the invention. For the "silica" stabilized method, the process of Example 1 of U.S. Pat. No. 4,833,060 was followed except that the materials were as described in Table 2, the aliphatic amide, as indicated in Table 2 was first milled to produce a concentrate and the solvent was ethyl acetate. The concentrate was added to the polymer binder solution.

For the "latex" stabilized method, the process of Example 4 of U.S. Pat. No. 5,049,469 was followed with the exceptions noted above.

The aliphatic amide concentrate was prepared by media milling (13% by weight solids of which 90% was the aliphatic amide and 10% was the copolymer binder indicated in Table 2) for 3 hours in ethyl acetate.

In the Tables below, the designation "C" indicates a comparative example.

TABLE 2

| Ex. | Binder | Pigment | CCA | Particulate Stabilizer | Additive |
|---|---|---|---|---|---|
| C1 | Styrene-Butyl Acrylate Copolymer | None | 0.4% CCA-1 | Silica | None |
| C2 | Styrene-Butyl Acrylate Copolymer | None | 0.4% CCA-1 | Latex | None |
| 1 | Styrene-Butyl Acrylate Copolymer | None | 0.4% CCA-1 | Silica | 2.5% Stearamide |
| 2 | Styrene-Butyl Acrylate Copolymer | None | 0.4% CCA-1 | Silica | 5.0% Stearamide |
| 3 | Styrene-Butyl Acrylate Copolymer | None | 0.4% CCA-1 | Silica | 7.5% Stearamide |
| 4 | Styrene-Butyl Acrylate Copolymer | None | 0.4% CCA-1 | Silica | 10.0% Stearamide |
| 5 | Styrene-Butyl Acrylate Copolymer | None | 0.4% CCA-1 | Latex | 2.5% Stearamide |
| 6 | Styrene-Butyl Acrylate Copolymer | None | 0.4% CCA-1 | Latex | 5.0% Stearamide |
| 7 | Styrene-Butyl Acrylate Copolymer | None | 0.4% CCA-1 | Latex | 7.5% Stearamide |
| 8 | Styrene-Butyl Acrylate Copolymer | None | 0.4% CCA-1 | Latex | 10.0% Stearamide |
| 9 | Styrene-Butyl Acrylate Copolymer | None | 0.4% CCA-1 | Latex | 2.5% Stearic Acid |
| 10 | Styrene-Butyl Acrylate Copolymer | None | 0.4% CCA-1 | Latex | 5.0% Stearic Acid |
| 11 | Styrene-Butyl Acrylate Copolymer | None | 0.4% CCA-1 | Latex | 7.5% Stearic Acid |
| 12 | Styrene-Butyl Acrylate Copolymer | None | 0.4% CCA-1 | Latex | 10.0% Stearic Acid |
| 13 | Styrene-Butyl Acrylate Copolymer | None | 0.4% CCA-1 | Silica | 2.5% Euracamide |
| 14 | Styrene-Butyl Acrylate Copolymer | None | 0.4% CCA-1 | Latex | 5.0% Euracamide |
| 15 | Styrene-Butyl Acrylate Copolymer | None | 0.4% CCA-1 | Latex | 10.0% Euracamide |

TABLE 2-continued

| Ex. | Binder | Pigment | CCA | Particulate Stabilizer | Additive |
|---|---|---|---|---|---|
| 16 | Styrene-Butyl Acrylate Copolymer | None | 0.4% CCA-1 | Latex | 5.0% Ethylene bis (stearamide) |
| 17 | Styrene-Butyl Acrylate Copolymer | None | 0.4% CCA-1 | Latex | 10.0% Ethylene bis (stearamide) |
| 18 | Styrene-Butyl Acrylate Copolymer | None | 0.4% CCA-1 | Latex | 5.0% Palmitic Acid |
| 19 | Styrene-Butyl Acrylate Copolymer | None | 0.4% CCA-1 | Latex | 10.0% Palmitic Acid |
| 20 | Styrene-Butyl Acrylate Copolymer | None | 0.4% CCA-1 | Latex | 5.0% Stearamide |
| 21 | Styrene-Butyl Acrylate Copolymer | None | 0.4% CCA-1 | Latex | 7.5% Stearamide |
| 22 | Vinyl toulene-iso butyl methacrylate -methyl acrylate copolymer | None | 0.4% CCA-1 | Latex | 5.0% Stearamide |
| 23 | Vinyl toulene-methyl acrylate copolymer | None | 0.4% CCA-1 | Latex | 5.0% Stearamide |
| 24 | Styrene-iso butyl methacrylate -methyl acrylate copolymer | None | 0.4% CCA-1 | Latex | 5.0% Stearamide |
| 25 | Methyl methacrylate -methyl acrylate copolymer | None | 0.4% CCA-1 | Latex | 5.0% Stearamide |
| 26 | Iso-Butyl methacrylate -methyl acrylate copolymer | None | 0.4% CCA-1 | Latex | 5.0% Stearamide |
| 27 | Styrene-Butadiene Copolymer | None | 0.4% CCA-1 | Latex | 5.0% Stearamide |
| 28 | Vinyl toulene-Butadiene Copolymer | None | 0.4% CCA-1 | Latex | 5.0% Stearamide |
| C3 | Styrene-Butyl Acrylate Copolymer | 10% Bridged Aluminum Phtalocyanine | 0.4% CCA-1 | Latex | None |
| 29 | Styrene-Butyl Acrylate Copolymer | 10% Bridged Aluminum Phtalocyanine | 0.4% CCA-1 | Latex | 2.5% Stearamide |
| 30 | Styrene-Butyl Acrylate Copolymer | 10% Bridged Aluminum Phtalocyanine | 0.4% CCA-1 | Latex | 5.0% Stearamide |

TABLE 2-continued

| Ex. | Binder | Pigment | CCA | Particulate Stabilizer | Additive |
|---|---|---|---|---|---|
| 31 | Styrene-Butyl Acrylate Copolymer | 10% Bridged Aluminum Phtalocyanine | 0.4% CCA-1 | Latex | 7.5% Stearamide |
| 32 | Styrene-Butyl Acrylate Copolymer | 10% Bridged Aluminum Phtalocyanine | 0.4% CCA-1 | Latex | 10.0% Stearamide |
| 33 | Styrene-Butyl Acrylate Copolymer | 10% Bridged Aluminum Phtalocyanine | 0.25% CCA-2 | Latex | 5.0% Stearamide |
| 34 | Styrene-Butyl Acrylate Copolymer | 10% Bridged Aluminum Phtalocyanine | 0.5% CCA-3 | Latex | 5.0% Stearamide |
| 35 | Styrene-Butyl Acrylate Copolymer | 10% Bridged Aluminum Phtalocyanine | 0.5% CCA-4 | Latex | 5.0% Stearamide |
| 36 | Styrene-Butyl Acrylate Copolymer | 10% Bridged Aluminum Phtalocyanine | 0.5% CCA-5 | Latex | 5.0% Stearamide |
| 37 | Styrene-Butyl Acrylate Copolymer | 10% Bridged Aluminum Phtalocyanine | 0.5% CCA-6 | Latex | 5.0% Stearamide |
| 38 | Styrene-Butyl Acrylate Copolymer | 10% Bridged Aluminum Phtalocyanine | 0.5% CCA-7 | Latex | 5.0% Stearamide |
| 39 | Styrene-Butyl Acrylate Copolymer | 10% Bridged Aluminum Phtalocyanine | 2.0% CCA-8 | Latex | 5.0% Stearamide |
| C4 | Styrene-Butyl Acrylate Copolymer | 15% HOSTAPERM PINK E02 | 0.5% CCA-3 | Latex | None |
| 40 | Styrene-Butyl Acrylate Copolymer | 15% HOSTAPERM PINK E02 | 0.5% CCA-3 | Latex | 5.0% Stearamide |
| 41 | Styrene-Butyl Acrylate Copolymer | 15% HOSTAPERM PINK E02 | 0.5% CCA-3 | Latex | 7.5% Stearamide |
| C5 | Styrene-Butyl Acrylate Copolymer | 10% NOVAPERM YELLOW | 0.5% CCA-3 | Latex | None |
| 42 | Styrene-Butyl Acrylate Copolymer | 10% NOVAPERM YELLOW | 0.5% CCA-3 | Latex | 5.0% Stearamide |
| 43 | Styrene-Butyl Acrylate Copolymer | 10% NOVAPERM YELLOW | 0.5% CCA-3 | Latex | 7.5% Stearamide |
| C6 | Styrene-Butyl Acrylate Copolymer | 8% BLACK PEARLS 430 and 2% MONOLITE BLUE | 0.25% CCA-2 | Latex | None |
| 44 | Styrene-Butyl Acrylate Copolymer | 8% BLACK PEARLS 430 and 2% MONOLITE BLUE | 0.25% CCA-2 | Latex | 5.0% Stearamide |

TABLE 2-continued

| Ex. | Binder | Pigment | CCA | Particulate Stabilizer | Additive |
|---|---|---|---|---|---|
| 45 | Styrene-Butyl Acrylate Copolymer | 8% BLACK PEARLS 430 and 2% MONOLITE BLUE | 0.25% CCA-2 | Latex | 7.5% Stearamide |
| 46 | Styrene-Butyl Acrylate Copolymer | 8% BLACK PEARLS 430 and 2% PELIOGEN BLUE | 0.25% CCA-2 | Latex | 5.0% Stearamide |
| 47 | Styrene-Butyl Acrylate Copolymer | 8% Black Pearls 430 and 2% PELIOGEN BLUE | 0.25% CCA-2 | Latex | 7.5% Stearamide |

All of the above toner compositions were formulated into an electrostatic developer. The developer contained (1) 6.0 percent by weight of toner, described in Table 2, having a volume average particle diameter of about 3.5 micrometers and a toner charge of about 80–150 microcoulombs per gram of toner and (2) the remainder, lanthinum ferrite carrier particles, having a number average particle diameter of 10.0 to 38.0 micrometers thinly melt coated with a polymer resin (1.5 percent by weight of the carrier particles of poly (vinylidene fluoride) resin (KYNAR®301) obtained from the Pennwalt Chemical Company and 0.5 percent by weight of the carrier particles of PMMA resin (SOKEN® MP 1201).

An electrophotographic process similar to an Eastman Kodak IMAGESOURCE® 110 copier duplicator was used to produce images on poly(ethylene) resin coated paper. The images were fused using a belt fuser described in U.S. Pat. No. 5,089,363.

The image quality for all of the images was evaluated for all toner compositions and, because of the small particle size and narrow size distribution of the toner, all of the images were of excellent quality as judged by an experienced observer.

The images were then tested for abrasion resistance, vinyl sticking and finger print resistance. The abrasion resistance was measured by a commercially available instrument called a "Crock" Meter. The output from the meter is how many cycles does it take to visibly damage the surface. These numbers were then correlated into categories 1–5 corresponding to a scale from poor abrasion resistance at 5 to excellent at 1. Vinyl sticking were tested by keeping the images in contact with a plasticized PVC sheet containing 40% dioctyl phthalate plasticizer. The images were kept in contact under pressure for 72 hours at 50% relative humidity and 45° C. The ease at which the images separated from the vinyl was evaluated on a scale of from 1 to 5 with 1 being excellent. The finger print test was performed by placing various finger prints on samples of the images. Then, the finger prints were stored for various lengths of time. What is reported is the time, in minutes, at which the finger print could not be removed by buffing with a soft cloth.

The results of these tests are shown in Table 3. It is clear form the results that the toner compositions of the invention, compared with the toner compositions not containing the aliphatic amides or aliphatic acids, displayed excellent performance.

TABLE 3

| Ex | Abrasion Resistance Ranking | Vinyl Sticking Ranking | Finger print Resistance (Minutes) |
|---|---|---|---|
| C1 | 5 | 5 | 15 |
| C2 | 5 | 4 | 15 |
| 1 | 4–5 | 4–5 | 200 |
| 2 | 3–4 | 3–4 | 1,000 |
| 3 | 2–3 | 2–3 | Over 10,000 |
| 4 | 1–2 | 2–3 | Over 10,000 |
| 5 | 4–5 | 4 | 1,500 |
| 6 | 3–4 | 3 | Over 30,000 |
| 7 | 2–3 | 2 | Over 30,000 |
| 8 | 1–2 | 2 | Over 30,000 |
| 9 | 5 | 4–5 | 200 |
| 10 | 4–5 | 3–4 | 1,000 |
| 11 | 3–4 | 2–3 | Over 5,000 |
| 12 | 2–3 | 2–3 | Over 5,000 |
| 13 | 4–5 | 3–4 | 500 |
| 14 | 3–4 | 2–3 | Over 10,000 |
| 15 | 2–3 | 2–3 | Over 10,000 |
| 16 | 2–3 | 2 | Over 30,000 |
| 17 | 1–2 | 2 | Over 30,000 |
| 18 | 4–5 | 3–4 | 1,000 |
| 19 | 2–3 | 2–3 | Over 5,000 |
| 20 | 3–4 | 3 | Over 30,000 |
| 21 | 2–3 | 2 | Over 30,000 |
| 22 | 3–4 | 3 | Over 30,000 |
| 23 | 3–4 | 3 | Over 30,000 |
| 24 | 3–4 | 3 | Over 30,000 |
| 25 | 3–4 | 3 | Over 30,000 |
| 26 | 3–4 | 3 | Over 30,000 |
| 27 | 3–4 | 3 | Over 30,000 |
| 28 | 3–4 | 3 | Over 30,000 |
| C3 | 5 | 4 | 15 |
| 29 | 4–5 | 4 | 1,500 |
| 30 | 3–4 | 3 | Over 30,000 |
| 31 | 2–3 | 2 | Over 30,000 |
| 32 | 1–2 | 2 | Over 30,000 |
| 33 | 3–4 | 3 | Over 30,000 |
| 34 | 3–4 | 3 | Over 30,000 |
| 35 | 3–4 | 3 | Over 30,000 |
| 36 | 3–4 | 3 | Over 30,000 |
| 37 | 3–4 | 3 | Over 30,000 |
| 38 | 3–4 | 3 | Over 30,000 |
| 39 | 3–4 | 3 | Over 30,000 |
| C4 | 5 | 4 | 15 |
| 40 | 3–4 | 3 | Over 30,000 |
| 41 | 2–3 | 2 | Over 30,000 |
| C5 | 5 | 4 | 15 |
| 42 | 3–4 | 3 | Over 30,000 |
| 43 | 2–3 | 2 | Over 30,000 |
| C6 | 5 | 4 | 15 |
| 44 | 3–4 | 3 | Over 30,000 |
| 45 | 2–3 | 2 | Over 30,000 |
| 46 | 3–4 | 3 | Over 30,000 |
| 47 | 2–3 | 2 | Over 30,000 |

The invention has been described with particular reference to preferred embodiments thereof but it will be understood that variations and modifications can be effected within the spirit and scope of the invention. All the patents and other references cited above are fully incorporated by reference herein.

What is claimed is:

1. A method for forming a toner particle composition, said process comprising the steps of:

a) milling an aliphatic amide or an aliphatic acid in the presence of a binder polymer and a water immiscible organic binder solvent, thereby forming an aliphatic amide or aliphatic acid concentrate, said aliphatic amide or aliphatic acid having a particle size of less than one micrometer;

b) dissolving a binder polymer and a charge control agent in a water immiscible organic binder solvent, thereby forming a binder solution;

c) mixing said aliphatic amide or aliphatic acid concentrate with said binder solution, thereby forming an aliphatic amide- or aliphatic acid-binder polymer dispersion;

d) dispersing said aliphatic amide- or aliphatic acid-binder polymer dispersion in water containing a colloidal stabilizer, thereby forming an aqueous suspension of droplets;

e) subjecting said aqueous suspension of droplets to a shearing action, thereby reducing the size of the droplets and forming limited coalescence particles;

f) removing the water immiscible organic binder solvent from the limited coalescence particles, thereby forming toner particles in an aqueous medium; and g) drying the toner particles.

2. A method according to claim 1 wherein said milling step is carried out in a media mill.

3. A method according to claim 1 wherein said toner composition comprises 2.5 to 30% by weight of said aliphatic amide or aliphatic acid.

4. A method according to claim 3 wherein said toner composition comprises about 5 to 10% by weight of said aliphatic amide or said aliphatic acid.

5. A method according to claim 3 wherein said aliphatic amide is the compound stearamide.

6. A method according to claim 1 wherein said binder polymer is a styrene polymer of from 40 to 100 percent by weight of a styrene monomer and from 0 to 45 percent by weight of one or more alkyl acrylate monomers or alkyl methacrylate monomers.

7. A method according to claim 6 wherein said styrene monomer is selected from the group consisting of styrene and vinyltoluene, and said alkyl acrylate or methacrylate monomer is selected from the group consisting of methyl acrylate, methyl methacrylate, butyl acrylate, butyl methacrylate, isobutyl acrylate, isobutyl methacrylate, and mixtures thereof.

8. A method according to claim 1 wherein said binder polymer comprises:

a copolymer of (a) at least one vinyl aromatic monomer; and (b) at least one second monomer selected from the group consisting of a conjugated diene monomer and an acrylate monomer selected from the group consisting of alkyl acrylate monomers and alkyl methacrylate monomers.

* * * * *